United States Patent [19]

Prost et al.

[11] 4,175,395

[45] Nov. 27, 1979

[54] DISTRIBUTION OF GAS UNDER PRESSURE

[75] Inventors: Roger Prost, Saint Egreve; Bernard Manhes, Versailles, both of France

[73] Assignee: L'Air Liquide, Societe Anonyme pour l'Etude et l'Exploitation des Procedes Georges Claude, Paris, France

[21] Appl. No.: 862,513

[22] Filed: Dec. 20, 1977

[30] Foreign Application Priority Data

Dec. 23, 1976 [FR] France ..... 76 38827

[51] Int. Cl.[2] ..... F17C 7/02

[52] U.S. Cl. ..... 62/52; 62/55

[58] Field of Search ..... 62/45, 52, 53, 54, 55, 62/514 R

[56] References Cited

U.S. PATENT DOCUMENTS

| | | | |
|---|---|---|---|
| 2,028,119 | 1/1936 | Boshkoff | 62/53 |
| 2,035,396 | 3/1936 | Mesinger | 62/53 |
| 2,042,427 | 5/1936 | Kinzel | 62/54 |
| 3,260,061 | 7/1966 | Hampton et al. | 62/52 |
| 3,633,372 | 11/1972 | Kimmel | 62/52 |
| 3,898,853 | 8/1975 | Iung | 62/55 |

*Primary Examiner*—Ronald C. Capossela

*Attorney, Agent, or Firm*—Young & Thompson

[57] ABSTRACT

The present invention relates to a method of and a cryogenic installation for distributing gases.

From a storage tank at low pressure, successive portions of cryogenic liquid are withdrawn to an enclosure, which is isolated by closing a valve. After this, a further valve is opened, the effect of which is to cause the pressure in a receptacle to rise to the high distribution pressure and to allow the gas concerned to condense to a certain degree so that said enclosure is filled with liquid under pressure. The liquid evaporates partially at the periphery and is thus transferred to a heater and from there to a buffer container.

The invention is applicable in particular to the distribution of oxygen, nitrogen and argon under pressure.

8 Claims, 3 Drawing Figures

DISTRIBUTION OF GAS UNDER PRESSURE

BACKGROUND OF THE INVENTION

In the majority of applications for industrial gases, it is necessary to have the gas available at a relatively high pressure, generally of the order of 8 to 14 bars, in a distribution circuit. With many gases, when the throughputs involved are considerable it is usual to have a store of gas in the liquified state at low temperature and to evaporate it as demand requires. At the present time, this evaporation takes place at the high distribution pressure by heating either with purely atomspheric heaters or with auxiliary energy supply means. Whatever the methods of heating, in such a case the whole of the distributing circuit and the storage tank are thus at all times maintained at the high distribution pressure, which makes it necessary for the storage tank to be designed for this high pressure. Designing the tank in this way proves particularly costly in the case of cryogenic tanks which are formed by two shells which leave between them an insulating space under high vacuum with a filling of an insulating material such as "perlite". The result is that the inner shell has to be made of a pressure-resistant material. Installations of this kind are generally replenished at regular intervals by specialised vehicles fitted with transfer means such as pumps which allow the cryogenic liquid to be transferred from the low pressure tank carried by the vehicle to the high pressure distribution storage tank. This calls for a large outlay on means for pressurising the liquid together with a by no means neglible expenditure of energy for the transfer.

There has already been proposed a method of distributing gases at high pressure in which there is a stored volume of a gas available in the liquid state at low pressure, a portion of the said stored volume being extracted when the distribution pressure falls below a threshold value and being transferred to a confined enclosure at the said low pressure in which all communication between the said confined enclosure and the said stored volume is cut off and in which the distribution circuit at high pressure is placed in communication with the said enclosure. In this proposal, the confined enclosure is thermally insulated from the exterior and the communication with the distribution circuit is made by simultaneously balancing the pressure both in the gaseous phase and in the liquid phase in the confined enclosure, and the cryogenic liquid drains by gravity to a heating evaporator. Such an arrangement, although it enables the above-mentioned drawbacks to be overcome by allowing the storage tank to be designed for a low storage pressure, is relatively complex since it means not only that the confined enclosure has to be situated below the storage tank but also that the heating evaporator too has to be below the confined enclosure, which is a serious disadvantage from the point of view of bulk. Furthermore this arrangement, in addition to making it necessary for the confined enclosure to be thermally insulated, also requires a double connection to the heating evaporator through piping and valves. In addition, the draining of the liquid from the confined enclosure to the heating evaporator simply by gravity is a relatively time-consuming process.

It is an object of the invention to provide a method for distributing gases under pressure which is quickly put into effect, and also apparatus for carrying out this method which is small in bulk and of simple and inexpensive design.

SUMMARY OF THE INVENTION

The method of the invention arranges that during the whole operation of extracting and transferring the liquid at low pressure, the liquid which collects in the enclosure is thermally insulated from any source of heat and only the liquid phase is placed in communication with the distribution circuit at pressure, at the same time as at least a part of the liquid in the confined enclosure is placed in heat exchange with the external atmosphere, thus causing partial evaporation which allows the liquid to be transferred under pressure from the said enclosure to the heating evaporator. By virtue of the pneumatic thrust effect caused by a part of the liquid evaporating in the confined enclosure, it is ensured that the liquid is very quickly transferred to the heater, and this is able to occur even if gravity cannot play any part, i.e. if the confined enclosure is not situated above the heater.

The invention also provides apparatus for distributing gases under pressure, of the kind which comprises a storage tank for a liquidified gas, means for evaporating portions of liquified gas as required, a distribution circuit under pressure incorporating a heater and a pressure reducer and regulator in which installation the said storage tank is designed for a pressure appreciably lower than the distribution pressure, and in which a confined enclosure of small capacity designed for a pressure at least equal to the distribution pressure is connected by ducts containing valves on the one hand to the said storage tank and on the other hand to the said heater in the distribution circuit, and this installation is characterised in that the enclosure of small capacity incorporates an inner receptacle to receive the portion of liquid, which is spatially separated from a conductive wall which is not insulated from the exterior of the said enclosure, the connection to the distribution circuit being made by a single duct which opens into the said inner receptacle at a low point.

BRIEF DESCRIPTION OF THE DRAWINGS

In order that the invention may be more clearly understood, reference will now be made to the accompanying drawings, which show certain embodiments thereof by way of example and in which.

DETAILED DESCRIPTION OF PREFERRED EMBODIMENTS

Figure 1:
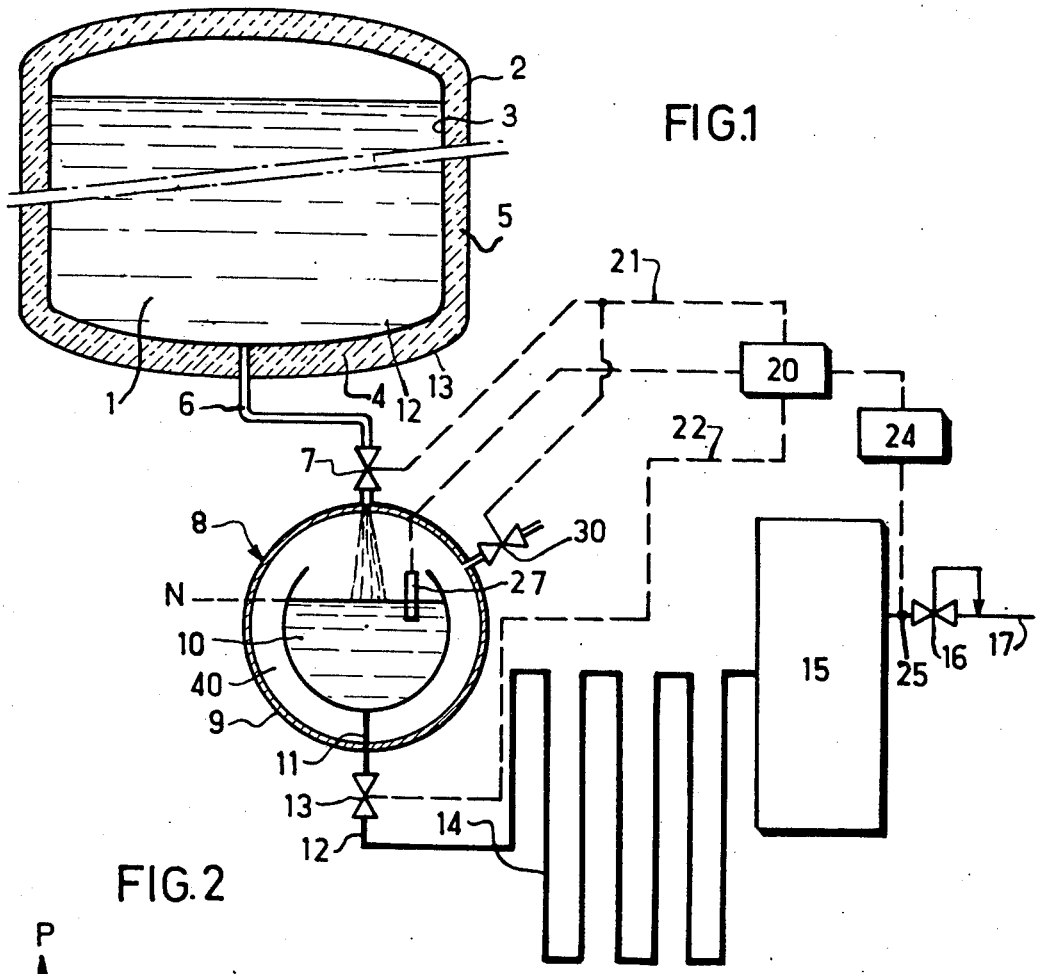
FIG. 1 is a schematic view of a cryogenic installation according to the invention for distributing gases under pressure.

Referring now to the drawings, and particularly to FIG. 1, an installation according to the invention contains a low pressure storage tank 1 which is formed by two shells 2 and 3 which leave between them a thermal insulating space 4 which is filled with insulating particles 5 such as particles of perlite. This tank is fitted with filling means (not shown). As was explained above, the storage tank 1 is maintained at a low gas pressure of the order of 1 to 3 bars. This storage tank 1 is connected by a duct 6 having a valve 7 to a confined enclosure 8 of small capacity which is designed to withstand the high distribution pressure and which to this end is formed by an outer shell 9 of thick material. Within the container 8 is positioned a receptacle 10 which is arranged vertically below the outlet of the duct 6 and which is made of a thin material. This inner receptable 10 is connected by a pipe 11 to a high pressure distribution circuit 12 via a valve 13. This distribution circuit 12 incorporates an atmospheric heater 14, a buffer container 15, a pressure regulator and reducer 16 and a distribution duct 17, the whole being designed to withstand the high distribution pressure. A regulating arrangement which is indicated diagrammatically at 20 allows the valves 7 and 13 to be opened and closed respectively, or vice versa. The arrangement 20 is controlled on the one hand by a pressure sensor 24 which measures the pressure in the distribution circuit at 25 between the buffer container 15 and the regulator and reducer 16, and on the other hand by a level monitoring device 27 which is positioned in the receptacle 10 inside the confined enclosure 8.

The installation operates as follows, reference now being made to FIG. 2 also. The initial situation as regards pressure is characterised by the fact that the distribution network has not been used for a time, so that the pressure in the distribution circuit at the measuring point 25 is for example a maximum Pmax. If gas is now extracted from the distribution duct 17, this gas will be supplied mainly by the buffer container 15 and the pressure measured at 25 by the pressure sensor 24 will drop gradually from Pmax to a pressure Pc or threshold pressure of 9 bars for example, whereas the pressure Pr supplied by the reducer 16 to the distribution duct 17 is regulated to 8 bars. As soon as the pressure P reaches the pressure Pc, the regulating arrangement 20 causes the valve 7 to open and the valve 13 to close, whereas previously they were closed and open respectively. Because of this, a portion of liquified gas is transferred from the storage tank 1 to the inner receptacle 10, which is initially empty of any liquid, in the confined enclosure 8. The space in the confined enclosure 8 is brought to ambient pressure by means of a valve 30 which is controlled by the regulating arrangement 20 to take up an open or closed position identical to that of valve 7. By means of this valve 30, the pressure in the confined enclosure 8 is maintained at atmospheric pressure and the cryogenic liquid is able to fill the inner receptacle 10. During the whole of this filling phase, the pressure inside the confined enclosure 9 is maintained substantially at the same pressure as the tank 1, but the cryogenic liquid which gradually builds up in the inner receptacle 10 is maintained substantially in the liquid state, by virtue of the thermal insulating effect produced by the gap 40 formed between the inner receptacle 10 and the wall of the confined enclosure 8. Although this wall of the confined enclosure 8 is in constant heat exchange with the outside atmosphere, there is only a small amount of evaporation, which is led off to the exterior through valve 30, and if required is collected by means which will not be described. As soon as the level of the cryogenic liquid has reached a maximum N, as shown in FIG. 1, the level device 27 causes the regulating arrangement 20 to change over the valves in sequence:valve 7 is first closed and then valve 13 is opened. The effect of valve 13 opening is to cause a sudden influx of gas from the distribution circuit 14, 15 to the confined enclosure 8. The effect of this is first of all to cause the incoming gas to be condensed by the liquid, which causes the enclosure 8 to be completely filled with liquid at a higher temperature and pressure than before. As soon as this happens, a peripheral zone of the volume of liquid in contact with the un-insulated outer shell 9 evaporates and thus causes the liquid to be transferred to the heater 14, where it evaporates completely and heats up before arriving at the buffer container 15.

Figure 2:
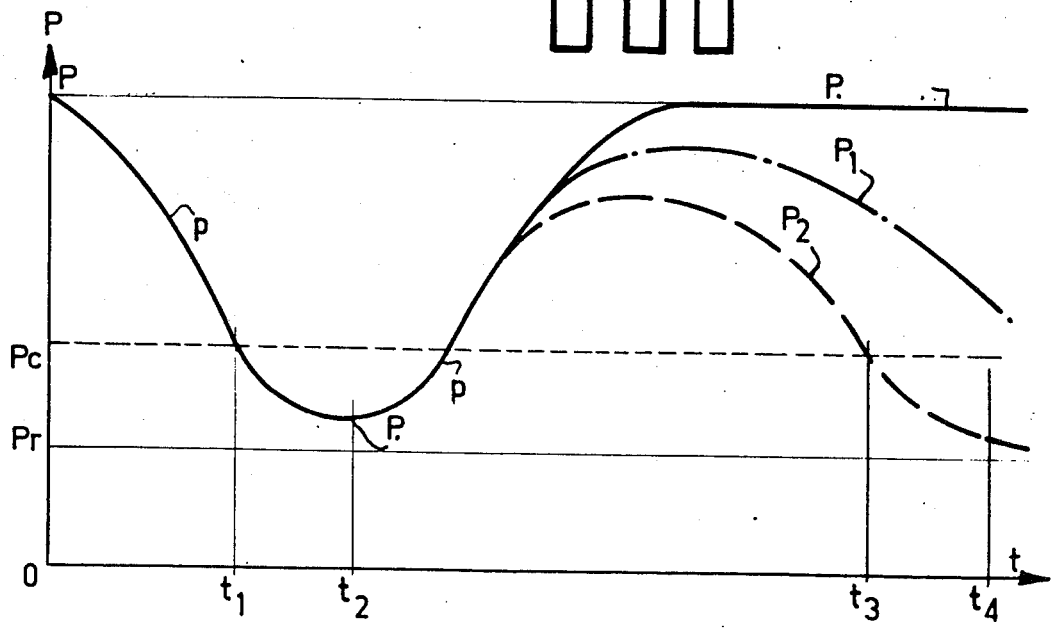
FIG. 2 is a graph showing the changes in the pressure in the storage container as a function of time.

In the course of the first phase of operation, which is concerned with the filling of the receptacle 10 with a portion of the cryogenic liquid, i.e. in the course of the interval t1–t2 shown in FIG. 2, the pressure P in the distribution circuit, i.e. the pressure measured at point 25, continues to drop until it reaches a minimum pressure Pmin at time t2. At time t2, as described above, valve 7 closes and valve 13 opens, which causes a portion of cryogenic liquid to be evaporated and the pressure P to rise from the pressure Pmin to the pressure Pmax if nothing is extracted from the distribution duct, or to intermediate pressures which are shown at P1 and P2 if more or less considerable amounts are extracted from duct 17. It should be noted that the whole arrangement is so designed that the pressure P min is always higher than the pressure Pr in the network. It will be appreciated that, as soon as the pressure P decreases again in such as way as to reach pressure Pc, the same process is repeated. For example, if the pressure P2 reaches pressure Pc at time t3, during an interval t3–t4 the same process as is described above during the interval t1–t2 is repeated.

Figure 3:
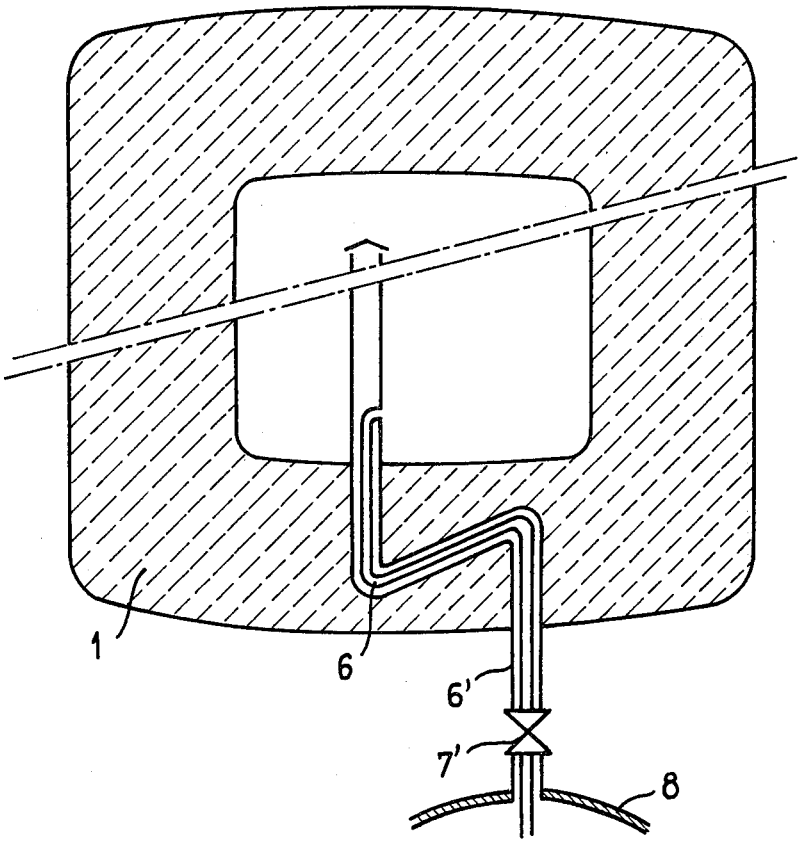
FIG. 3 is a partial view of a modified embodiment.

In the modification shown in FIG. 3, the duct 6 which connects the storage tank 1 to the confined enclosure is now surrounded by another duct 6' which is co-axial with duct 6 and which opens into the vapour phase in the tank 1. A double valve 7' is now responsible either for allowing the liquid and vapour phases in the tank 1 to communicate simultaneously with the enclosure or to be isolated therefrom simultaneously. The air duct 30 shown in FIG. 1 is unnecessary and is therefore not provided.

The present invention is applicable to the distribution of cryogenic gases under pressure such as, in particular, oxygen, nitrogen, argon and others.

I claim:

1. In apparatus for distributing gases under pressure, of the kind which comprises a storage tank for liquified gas, a distribution circuit under pressure which incorporates a heater and a pressure regulator and reducer, in which the said storage tank is designed for a pressure appreciably lower than the distribution pressure, and in which a confined enclosure of small capacity designed for a pressure at least equal to the distribution pressure is connected by ducts containing valves on the one hand to the said storage tank and on the other hand to the said heater in the distribution circuit, the improvement in which the enclosure of small capacity incorporates an inner receptacle to receive liquid from the storage tank, which is spatially separated from the conductive wall which is not insulated from the exterior of the said enclosure, the connection to the distribution circuit being made by a single duct which opens into the said inner receptacle at a low point.

2. Apparatus according to claim 1, wherein said confined enclosure and said storage tank are connected together by two ducts containing valves which open into said storage tank in the one case at a low point and in the outer case at a high point, wherein said confined enclosure is situated at a lower level than said storage tank, and wherein means are provided to open or close said valves simultaneously.

3. Apparatus according to claim 2, wherein said two ducts for making a connection to said storage tank are formed by a double duct consisting of coaxial tubes associated with one double control valve.

4. Apparatus according to claim 1, which incorporates a regulating arrangement which includes means for switching said valves serving said confined enclosure, said means being controlled on the one hand by a pressure sensor mounted upstream of said regulator and reducer, so that said confined enclosure can be connected to said storage tank at low pressure and can be isolated from said heater, under the control of said pressure sensor when the measured pressure declines to the level of the threshold pressure, and on the other hand by a means for measuring the level of liquid in said confined enclosure which is responsible for switching said valves in the opposite direction when the maximum liquid level is reached.

5. Apparatus according to claim 1, and means for equalizing the pressure in said storage tank and confined enclosure, by means other than said duct by which liquid flows from said storage tank to said confined enclosure, when the last-named duct is open, thereby to prevent flow of fluid through said last-named duct in a direction from said small enclosure toward said storage tank.

6. In a method of distributing gases at high pressure, in which a stored volume of gas is maintained in the liquified state at low pressure, portions of said stored liquified gas being intermittently moved to a confined enclosure and being raised in pressure in said confined enclosure to a high pressure and then being moved from said confined enclosure in liquid phase to a vaporization and distribution circuit; the improvement comprising thermally insulating the liquid in said confined enclosure from any source of heat while liquid is moving from said stored volume to said confined enclosure, and thereafter interrupting communication between said stored volume and said confined enclosure and placing a portion of the liquid in said confined enclosure in heat exchange with the external atmosphere thereby causing partial evaporation of said liquid in said confined enclosure to raise said liquid in said confined enclosure to said high pressure.

7. A method according to claim 6, and maintaining the pressure in said stored volume and said confined enclosure equal at all times that said stored volume and confined enclosure communicate with each other, thereby to prevent flow of fluid from said confined enclosure in the direction of said stored volume.

8. A method according to claim 6, and establishing communication between said confined enclosure and said circuit simultaneously as communication is interrupted between said stored volume and said confined enclosure.

* * * * *